US006811285B2

(12) United States Patent
Ferguson et al.

(10) Patent No.: US 6,811,285 B2
(45) Date of Patent: Nov. 2, 2004

(54) METHOD AND STRUCTURE FOR ATTACHING A LENS TO A HOUSING IN AN AUTOMOTIVE LIGHTING ASSEMBLY

(75) Inventors: Wendell G. Ferguson, Daleville, IN (US); Nova Filbrun, Pendleton, IN (US); R. Andrew Kidd, Alexandria, IN (US)

(73) Assignee: Guide Corporation, Pendleton, IN (US)

( * ) Notice: Subject to any disclaimer, the term of this patent is extended or adjusted under 35 U.S.C. 154(b) by 0 days.

(21) Appl. No.: 10/279,660

(22) Filed: Oct. 24, 2002

(65) Prior Publication Data

US 2004/0080944 A1 Apr. 29, 2004

(51) Int. Cl.[7] ..... F21V 31/00
(52) U.S. Cl. ..... 362/267; 362/310; 362/546
(58) Field of Search ..... 362/267, 310, 362/158, 311, 329, 375, 362, 509, 510, 520, 544, 546, 549

(56) References Cited

U.S. PATENT DOCUMENTS

| | | | | |
|---|---|---|---|---|
| 4,118,767 A | | 10/1978 | Urbanek | |
| 4,128,864 A | | 12/1978 | Brussee et al. | |
| 4,545,001 A | | 10/1985 | English et al. | |
| 4,574,338 A | | 3/1986 | Takasaki et al. | |
| 4,660,128 A | | 4/1987 | Bergin et al. | |
| 4,679,128 A | | 7/1987 | Van Duyn et al. | |
| 4,740,875 A | | 4/1988 | Wyckoff et al. | |
| 4,839,785 A | | 6/1989 | Ohishi | |
| 4,928,215 A | | 5/1990 | Fujino et al. | |
| 4,930,050 A | | 5/1990 | Poizner | |
| 4,931,915 A | | 6/1990 | Quiogue | |
| 4,972,301 A | | 11/1990 | Kasboske | |
| 5,001,610 A | * | 3/1991 | Otaka | 362/510 |
| 5,021,651 A | | 6/1991 | Ishikawa | |
| 5,119,282 A | | 6/1992 | Meyer et al. | |
| 5,188,444 A | | 2/1993 | Makita et al. | |
| 5,221,137 A | | 6/1993 | Lovelace et al. | |

(List continued on next page.)

FOREIGN PATENT DOCUMENTS

| | | |
|---|---|---|
| EP | 0500331 A1 | 8/1992 |
| EP | 0818856 A1 | 1/1998 |

(List continued on next page.)

*Primary Examiner*—Sandra O'Shea
*Assistant Examiner*—Bao Q. Truong
(74) *Attorney, Agent, or Firm*—Jay Taylor; Ice Miller

(57) ABSTRACT

Disclosed is a means and method for attaching an automotive lighting lens to the housing of an automotive lighting assembly while a structural adhesive cures. An automotive lighting assembly has a recessed hollow portion dimensioned to enclose one or more light fixtures and an open end with a peripheral edge. Formed around the periphery of the housing is a sealing groove and a plurality of engaging openings adjacent the groove. The engaging openings have a plurality of protuberances projecting into the opening, the protuberances providing a reduced area of clearance within the engaging opening. A covering lens has an exterior edge and a flange dimensioned to extend into and mate with the sealing groove formed around the edge of the lens. A plurality of projections are formed on the lens and positioned to coincide and mate with the engaging openings and dimensioned to have a cross section that causes the projections to engage the protuberances to produce frictional engagement and retention when the projections are inserted into the engaging openings. A curable adhesive is positioned within the sealing groove. When the lens is pressed onto the housing, the flange mates with the groove, and the projections frictionally engage the openings so that the lens is retained in position until the curable adhesive cures sealing the flange in the groove.

12 Claims, 3 Drawing Sheets

U.S. PATENT DOCUMENTS

| | | | | | |
|---|---|---|---|---|---|
| 5,283,719 | A | | 2/1994 | Sekiguchi | |
| 5,343,370 | A | | 8/1994 | Ohashi et al. | |
| 5,361,168 | A | | 11/1994 | Arai et al. | |
| 5,448,454 | A | * | 9/1995 | Nonaka | 362/546 |
| 5,455,747 | A | | 10/1995 | Aoyama | |
| 5,477,441 | A | | 12/1995 | Budnovitch et al. | |
| 5,552,969 | A | | 9/1996 | Murakami | |
| 5,560,706 | A | * | 10/1996 | Yamazaki et al. | 362/549 |
| 5,609,407 | A | | 3/1997 | Yanagihara et al. | |
| 5,626,413 | A | * | 5/1997 | Ferrell | 362/549 |
| 5,813,750 | A | | 9/1998 | Chou | |
| 5,938,310 | A | | 8/1999 | Leaman et al. | |
| 6,089,731 | A | | 7/2000 | Sugiyama et al. | |
| 6,113,254 | A | | 9/2000 | Kaneko | |
| 6,126,304 | A | | 10/2000 | Gotoh et al. | |
| 6,151,951 | A | | 11/2000 | Kawano | |
| 6,159,317 | A | | 12/2000 | Sugiyama et al. | |
| 6,203,177 | B1 | | 3/2001 | Watanabe et al. | |
| 6,215,602 | B1 | | 4/2001 | Kubo et al. | |
| 6,217,202 | B1 | | 4/2001 | Kageyama et al. | |
| 6,257,749 | B1 | | 7/2001 | Ward et al. | |
| 6,280,071 | B1 | | 8/2001 | Yamamoto et al. | |
| 6,318,883 | B1 | * | 11/2001 | Sugiyama et al. | 362/267 |

FOREIGN PATENT DOCUMENTS

| | | | |
|---|---|---|---|
| JP | 61100710 | | 5/1986 |
| JP | 01262501 | A | 10/1989 |
| JP | 03033801 | A | 2/1991 |
| JP | 04253010 | A | 9/1992 |
| JP | 04253012 | A | 9/1992 |
| JP | 08289081 | A | 11/1996 |
| JP | 10293272 | | 11/1998 |
| JP | 09244290 | | 3/1999 |
| JP | 2000147432 | A | 5/2000 |
| JP | 2000235802 | A | 8/2000 |
| JP | 2000294028 | A | 10/2000 |
| WO | WO 97 40521 | | 10/1997 |

* cited by examiner

METHOD AND STRUCTURE FOR ATTACHING A LENS TO A HOUSING IN AN AUTOMOTIVE LIGHTING ASSEMBLY

FIELD OF THE INVENTION

The present invention relates generally to automotive lighting assemblies and methods of assembling automotive lighting assemblies. In particular, the present invention relates to a means for attaching a lens to a housing of an automotive lighting assembly while a structural adhesive cures.

BACKGROUND

Automotive lighting systems generally include a housing, a light source such a light fixture and bulb, a reflector which can be part of the housing and an overlying lens. The housing and lens are typically separately formed by injection molding of plastic. The lens, which can be clear or have a transparent color such as red or amber, serves to cover and protect the light fixture and bulb and protect the interior of the assembly from the elements while a vehicle travels down the road. The complete assembly is mounted in a predesigned recess on the body of the automobile so that the assembly mounts aerodynamically flush with the body.

Lenses for automotive lighting assemblies must be fixedly attached to the housings of such assemblies and sealed to prevent ingress of moisture and debris. Generally, structural adhesives can be used to accomplish such attachment. Typical adhesives are curable adhesives that harden over time either though chemical reaction or drying and may include such curable adhesive as epoxy adhesives, acrylic adhesives, polyurethane adhesives, silicone adhesives, anaerobic adhesives, cyanoacrylate adhesives, phenolic adhesives, polymide adhesives, plastisol adhesives, and polyvinyl acetate adhesives.

Unfortunately, upon application, curable adhesives need time to cure before a lens will become fixedly attached to the housing. During this curing period, a lens has a tendency to move from its desired mating position with the housing thereby compromising the attachment and/or the seal unless the lens is held stationary with respect to the housing. Thus, lenses in automotive lighting systems utilizing structural curable adhesives for attachment to housings have required one of various prior art types of "temporary" attaching means while the adhesives cure. Such means currently known in the art include sonic tacking, lens clips, and snaps. These temporary attaching means, however, require special manufacturing tools or additional labor steps, and result in increased labor and tooling costs. For example, additional mechanical means, such as lens clips or snaps require additional parts, tooling or labor steps to attach. While sonic tacking does not require additional parts per se, it does require an extra assembly process and special equipment. These additional parts, equipment or assembly processes result in a more expensive, labor intensive assembly. Such a result is undesirable where it is a common goal to reduce the overall cost of the vehicle.

Therefore, it is desirable object of the present invention to provide a simple, economical means, other than those prior art methods briefly described above, for securing a lens to the housing of an automotive lighting assembly while a structural adhesive cures that does not involve additional labor steps, parts or special equipment.

INVENTION SUMMARY

The present invention comprises a means and method for attaching an automotive lighting lens to the housing of an automotive lighting assembly while a structural adhesive cures. An automotive lighting assembly in accordance with the present invention comprises a housing having a recessed hollow portion dimensioned to enclose one or more light fixtures and having an open end with a peripheral edge around said open end. Formed around the periphery of the housing is a sealing groove and a plurality of engaging openings formed adjacent said groove. The engaging openings have a plurality of protuberances projecting into the opening, the protuberances providing a reduced area of clearance within the engaging opening. A covering lens has an exterior edge and one or more transparent windows for passing light. The lens has a flange dimensioned to extend into and mate with the sealing groove formed around the edge of the lens. A plurality of projections are formed on the lens and positioned to coincide and mate with the engaging openings and dimensioned to have a cross section that causes the projections to engage the protuberances to produce frictional engagement and retention when the projections are inserted into the engaging openings. A curable adhesive positioned within the sealing groove so that when the lens is pressed onto said housing so that the flange mates with the groove, and the projections frictionally engage the openings, the lens is retained in position until the curable adhesive cures sealing said flange in said groove.

The projections are typically cylindrical in shape and the protuberances have a pointed apex. The pointed apexes may be the corners of squared shaped projections that extend into the openings. The curable adhesive can be any one of a number of well known industrial curable adhesives and typically may be selected from the group epoxy adhesives, polyurethane adhesives, silicone adhesives, anaerobic adhesives, cyanoacrylate adhesives, acrylic adhesives, phenolic adhesives, polymide adhesives, plastisol adhesives, and polyvinyl acetate adhesives.

DETAILED DESCRIPTION OF THE PREFERRED EMBODIMENT

Figure 1:
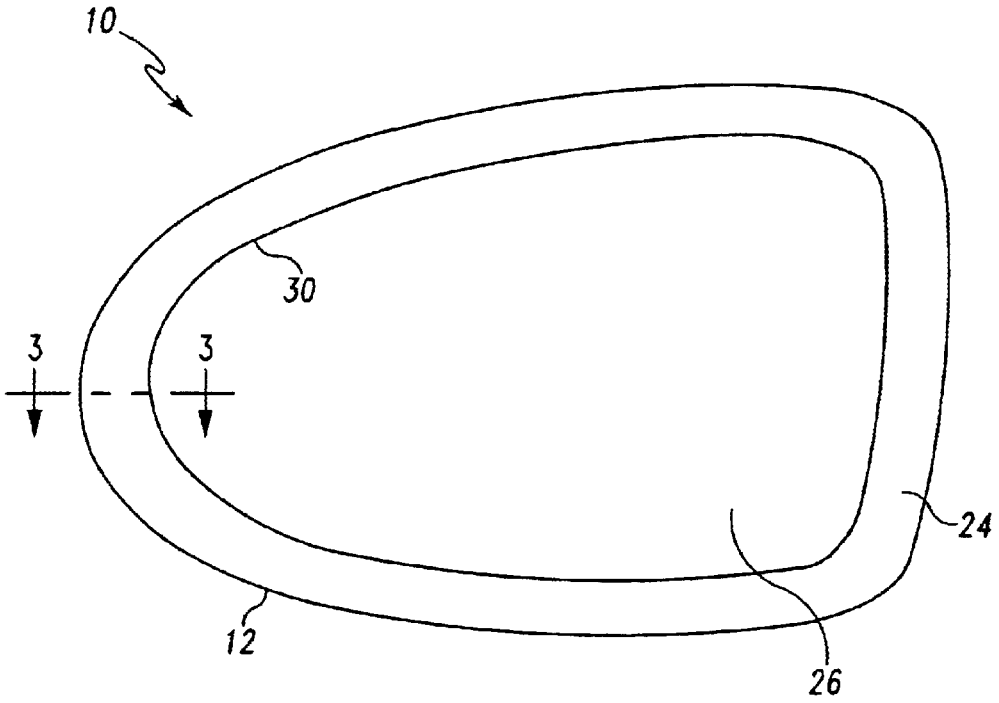
FIG. 1 if a front plan view of an embodiment of a typical automotive lighting assembly in accordance with the present invention.
Figure 2:
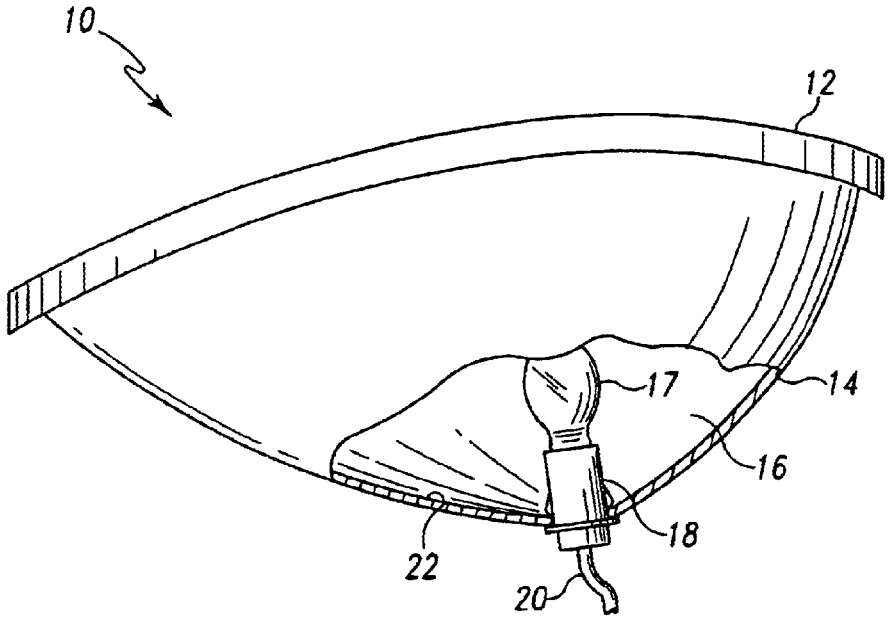
FIG. 2 is a bottom partially exposed plan view of the automotive lighting assembly of FIG. 1.

With reference to FIGS. 1 and 2, an automotive lighting assembly 10 comprises a lens 12 which over lies a housing 14. As shown in FIG. 2, housing 14 has a curved profile and forms a hollow recessed portion 16 which contains a lighting fixture 18 into which a bulb 17 is placed. Lighting fixture 18 is typically inserted into a opening in the base of housing 14 and retained by any of a number of well known frictional retention means such as snap clips or metal or plastic expanding clips. Power for the bulb 17 is supplied by an electrical cable 20 which is connected to the electrical system of the automobile (not shown). The interior surface 22 of housing 14 may be coated with a reflective coating so that light is reflected out of the assembly 13 through lens 12. Lens 12 has a rim 24 which is typically formed of a dark colored plastic, and one or more overlying transparent windows 26 which may be either a clear plastic or an appropriately colored transparent plastic such red or amber, depending on the purpose of the window. Front lighting assemblies typically have clear for the head lights and parking lights and amber windows for the turn signals. Rear light assemblies may have red windows for brake lights, clear windows for back-up lights, and amber windows for turn signals. Depending on the make and model automobile, the back lighting assembly may comprise all three lights, brake, back up and turn signal, in one assembly, subcombinations of each, or separate assemblies. Similarly, front light assemblies can combine head light, parking light and turn signal lights in one assembly, or any combination thereof.

Figure 3:
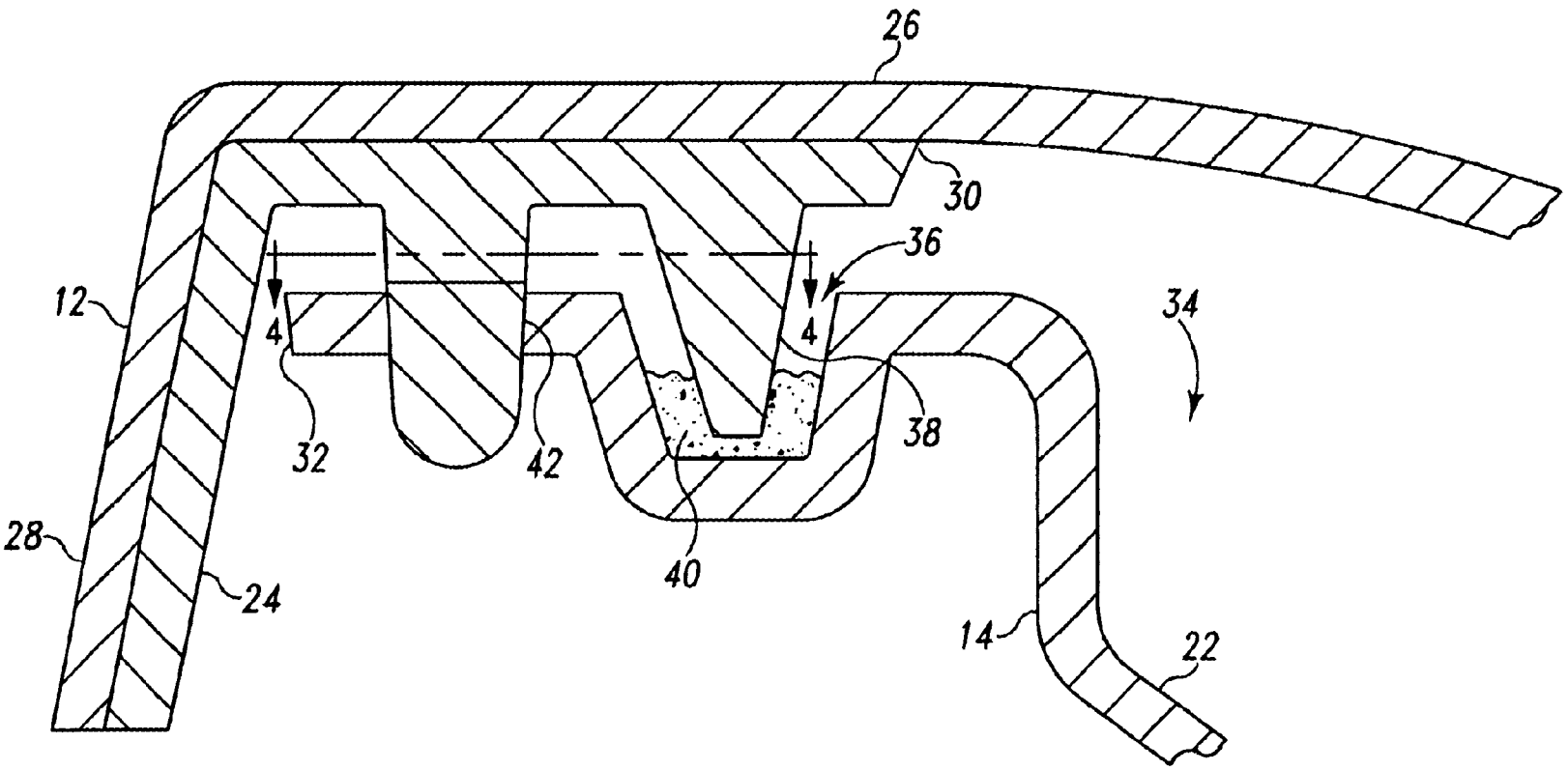
FIG. 3 is a side partial cross sectional view of the edge of an automotive lighting assembly taken substantially along line 3—3 in FIGS. 1 and 4, showing the present invention incorporated thereon.

With reference to FIG. 3, lens 12 comprises a rim portion 24 over which a transparent layer 28 is molded. The window 26 is outlined by and defined by the inner edge 30 of rim portion 24 which encircles the entire window 26. Housing 14 has an exterior edge 32 around the entire periphery of housing 14. Housing 14 has an open end 34 over which lens 12 overlies. Formed round the periphery of the edge 32 of the housing 14 is an essentially U shaped sealing groove 36. Rim portion 24 of lens 12 has a flange 38 formed on the under surface of rim 24 that is formed and dimensioned to coincide with and mate with sealing groove 36 around the entire peripheral edge 32 of housing 14. A curable adhesive 40 is placed in groove 36 in sufficient quantity that it encompasses the lower edge of flange 38 so that when the curable adhesive cures, it adheres to and seals the flange 38 in groove 36.

Also provided adjacent groove 36 along the peripheral edge 32 of housing 14 are a plurality of engaging openings 42. Formed on the inner surface of rim portion 24 of lens 12 are a plurality of projections 44 which are positioned and dimensioned to mate with openings 42 around the periphery of housing 14.

Figure 4:
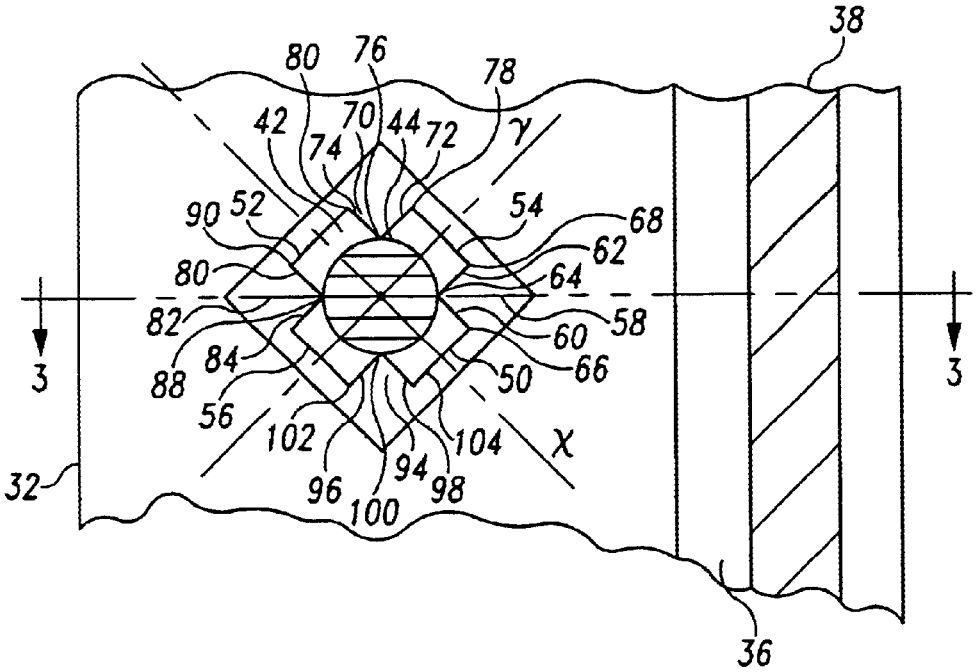
FIG. 4 is a top partial view of an engaging opening in accordance with the present invention taken essentially along line 4—4 in FIG. 3.

With reference to FIG. 4, the configuration of openings 42 is illustrated. Openings 42 have an "x" and a "y" axis that intersect at right angles to one another. First and second opposing walls 50 and 52, intersect the x axis approximately perpendicularly to the x axis at about the center of walls 50 and 52 respectively. Third and fourth opposing walls 54 and 56 intersect the y axis approximately perpendicularly to the y axis at about the center of walls 54 and 56 respectively. A first corner element 58 has a first and a second corner wall 60 and 62 are joined along one edge of each corner wall to form an apex 64. The other edge of said first and second corner walls are joined to a first edge 66 of said first opposing wall 50 and a second edge 68 of said third opposing wall 54 respectively. A second corner 70 has a first and a second corner wall 72 and 74 joined along one edge of each corner wall at an apex 76. The other edge of the corner walls 72 and 74 are joined to a first edge 78 of the third opposing wall 54 and the second edge 80 of said second opposing wall 52 respectively. A third corner 82 has a first and second corner walls 84 and 86 joined along one edge of each corner wall 84 and 86 at an apex 88. The other edge of said corner walls 84 and 86 are joined to the first edge 90 of the second opposing wall 52 and the second edge 92 of said fourth opposing wall 56 respectively. A fourth corner 94 has first and second corner walls 96 and 98 joined along one edge of each corner wall at an apex 100. The other edge of said corner walls 96 and 98 are joined to said first edge 102 of said fourth opposing wall 56 and to the second edge 104 of said first opposing wall 50 respectively.

As can be seen, corners 58, 70, 82 and 94 form corner shaped protuberance that project into opening 42 and the apexes 64, 76, 88 and 100 reduce the area of clearance through opening 42. Projection 44 is dimensioned so that its diameter is slightly greater than the distance between the opposing apexes 64 and 88, and opposing apexes 76 and 100. Thus, projection 44 engages apexes 64, 76, 88, and 100 when projection 44 is pushed into opening 42 to create a frictional engagement that retains the projections and prevents the lens from separating from the housing as the adhesive cures.

During assembly, structural adhesive 40 is placed in adhesive groove 36 of housing 14. Then, the lens 12 is placed over the open end of housing 14 so that projections 44 align with openings 42, and flange 38 aligns with groove 36. The lens 12 and housing 14 are then pressed together so that projections 44 enter openings 42 and the apexes 64, 76, 88 and 100 of corners 58, 70, 82 and 94 engage the surface of projections 44 and so that flange 38 is seated in groove 36 until the edge of flange 38 is submerged into adhesive 40. Depending upon the size and shape of the automotive lighting assembly, a variable number of projections 44 and openings 42 could be spaced around lens 12 and housing 14, respectively, as are necessary to ensure a secure engagement between lens 12 and housing 14 while the structural curable adhesive 40 in adhesive groove 36 cures and secures flange 38 of lens 12 to housing 14.

By eliminating the need for sonic tacking, lens clips and snapping features, the present invention reduces the costs associated with attaching lens 12 to housing 14 of a lighting device. Specifically, the costs of purchasing such parts or equipment, and/or maintaining and installing such items are avoided by using the means of the present invention to attach lens 12 to housing 14.

As will be appreciated by those skilled in the art, various alterations, modifications and changes could be made to the embodiment discussed above without departing from the spirit and intent of the present invention as defined in the appended claims

What is claimed is:

1. An automotive lighting assembly comprising:

a housing having a recessed hollow portion dimensioned to enclose one or more light fixtures and having an open end with a peripheral edge around said open end, said housing having a sealing groove fanned around said peripheral edge and a plurality of engaging openings fanned and spaced apart from said groove, said engaging openings having a plurality of protuberances projecting into said opening, said protuberances providing a reduced area of clearance within said engaging opening;

a covering lens having an exterior edge, said lens having one or more transparent windows for passing light, a flange dimensioned to extend into and mate with said sealing groove formed around said edge of said lens, and a plurality of projections positioned to coincide and mate with said engaging openings and dimensioned to have a cross section that causes said projections to engage said protuberances to produce frictional engagement and retain said projections when said projections are inserted into said engaging openings;

a curable adhesive positioned within said sealing groove so that when said lens is pressed onto said housing so that said flange mates with said groove, and said projections frictionally engage said openings, said lens is retained in position until said curable adhesive cures sealing said usage in said groove.

2. An automotive lighting assembly as claimed in claim 1, wherein said projections are cylindrical in shape.

3. An automotive lighting assembly as claimed in claim 1, wherein said protuberances have a pointed apex.

4. An automotive lighting assembly as claimed in claim 1, wherein said engaging openings having a plurality of protuberances each comprise an opening having an x and y axis, first an second opposing walls each having first and second edges centrally intersecting said x axis approximately perpendicularly to said x axis, third and fourth opposing walls each having first and second edges centrally intersecting said y axis approximately perpendicularly to said y axis, a first coiner having a first and a second corner wall joined along one edge of each corner wall at an apex, and joined at another edge of said first and second corner walls to said first edge of said first opposing wall and second first edge of said third opposing wall respectively, a second corner having a first and a second corner wall joined along one edge of each coiner wall at an apex, and joined at another edge of said corner walls to said first edge of said third opposing wall and said second edge of said second opposing wall respectively, a third corner having first and second corner walls joined along one edge of each corner wall at an apex, and joined at another edge of said corner walls to said first edge of said second opposing wall and said second edge of said fourth opposing wall respectively, a fourth corner having first and second corner walls joined along one edge of each corner wall at an apex, and joined at another edge, of said corner wall to said first edge of said fourth opposing wall and said second edge of said first opposing wall respectively.

5. An automotive lighting assembly as claimed in claim 1, wherein said engaging openings having a plurality of protuberances each comprise an opening having an x and y axis, first an second opposing walls each having first and second edges centrally intersecting said x axis approximately perpendicularly to said x axis, third and fourth opposing walls each having first and second edges centrally intersecting said y axis approximately perpendicularly to said y axis, a first corner having a first and a second corner wall joined along one edge of each corner wall at an apex, and joined at another edge of said first and second corner walls to said first edge of said first opposing wall and second first edge of said third opposing wall respectively, a second corner having a first and a second corner wall joined along one edge of each corner wall at an apex, and joined at another edge of said cower walls to said first edge of said third opposing wall and said second edge of said second opposing wall respectively, a third corner having first and second corner walls joined along one edge of each corner wall at an apex, and joined at another edge of said corner walls to said first edge of said second opposing wall and said second edge of said fourth opposing wall respectively, a fourth corner having first and second corner walls joined along one edge of each corner wall at an apex, and joined at another edge, of said corner wall to said first edge of said fourth opposing wall and said second edge of said first opposing wall respectively.

6. A method of making an automotive lighting lens assembly comprising said steps of:

a. forming a housing having a recessed hollow portion and having an open end with an edge around said open end, said housing having a sealing groove formed around said edge and a plurality of engaging openings formed and spaced apart from said groove, said engaging openings formed to have a plurality of protuberances projecting; into said opening, said protuberances providing a reduced area of clearance within said engaging opening;

b. forming a covering lens having an exterior edge, said lens haying one or more transparent windows for passing light, said lens formed to have flange dimensioned to extend into and mate with said sealing groove formed around said edge of said lens and said lens formed to have a plurality of projections positioned to coincide and mate with said engaging openings and dimensioned to have a cross section that causes said projections to engage said protuberances to produce friction engagement and retain said projections when said projections are inserted into said engaging openings;

c. placing a curable adhesive within said sealing groove;

d. pressing said lens onto said housing so that said flange mates with said groove and contacts said adhesive, and said projections frictionally engage said openings so that said lens is retained in position;

e. allowing said curable adhesive to cure thereby scaling said flange in said groove.

7. A method as claimed in claim 6, wherein said projections are formed to be cylindrical in shape.

8. A method as claimed in claim 6, wherein said engaging openings having a plurality of protuberances are formed so that each comprise an opening having an x and y axis, first and second opposing walls each having first aid second edges centrally intersecting said x axis approximately perpendicularly to said x axis, third and fourth opposing; walls each having first and second edges centrally intersecting said y axis approximately perpendicularly to said y axis, a first corner having a first and a second corner wall joined along one edge of each corner wall at an apex, and joined at another edge of said first and second corner walls to said first edge of said first opposing wan and said second edge of said third opposing wall respectively, a second corner having a first and a second corner wall joined along one edge of each corner wall at an apex, and joined at another edge of said corner walls to said first edge of said third opposing wall and said second edge of said second opposing wall respectively, a third corner having firs and second corner walls joined along one edge of each corner wall at an apex, and joined at another edge of said corner walls to said first edge of said second opposing wall and said second edge o said fourth opposing wall respectively, a fourth corner having first and second corner w joined along one edge of each corner wall at an apex, and joined at another edge of said corner wall to said first edge of said fourth opposing wall and said second edge of said first opposing wall respectively.

9. An method of making an automotive lighting assembly as claim 6, wherein said curable adhesive is selected from a group consisting off anaerobic adhesives, cyanoacrylate adhesives, acrylic adhesives, epoxy adhesives, polyurethane adhesives, silicone adhesives phenolic adhesives, polymide adhesives, plastisol adhesives, and polyvinyl acetate adhesives.

10. An automotive lighting assembly comprising:

a housing having a recessed hollow portion dimensioned to enclose one or more light fixtures and having an open end with an edge around said open end, said housing having a sealing groove formed around said edge and a plurality of engaging openings formed adjacent said groove, said engaging openings each comprising an opening having an x and y axis, first and second opposing walls earn having first and second edges centrally intersecting said x axis approximately perpendicularly to said x axis, third and fourth opposing walls each having first and second edges centrally intersecting said y axis approximately perpendicularly to said y axis, a first corner having a first and a second corner wall joined along one edge of each corner wall at second corner walls joined along one edge of each corner wall at an apex, and joined at another an apex, and joined at another edge of said first and second corner walls to said first edge of said first opposing wall and said second edge of said third opposing wall respectively, a second corner having a first and a second comet wall joined along one edge of each corner wall at an apex, and joined at another edge, of said corner walls to said first edge of said third opposing wall and said second edge of said second opposing wall respectively, a third corner having first and edge of said corner walls to said first edge of said third opposing wall and said second edge of said fourth opposing wall respectively, a fourth corner having first and second corner walls joined along one edge of each corner wall at an apex, and joined at another edge of said corner wall to said first edge of said fourth opposing wall and said second edge of said first opposing wall respectively, a covering lens having an exterior edge, said lens having one or more transparent windows for passing light, a flange dimensioned to extend into and mate with said scaling groove formed around said, edge of said lens, and a plurality of projections positioned to coincide and mate with said engaging openings and dimensioned to have a cross section that causes said projections to, engage said apexes of said corners to produce frictional engagement when projections are inserted into said engaging openings;

a curable adhesive positioned within said sealing groove so that when said lens is pressed onto, said housing so that said flange mates with said groove, and said projections frictionally engage said corners, said lens is retained in position until said curable adhesive cures sealing said flange in said groove.

11. An automotive lighting assembly as claimed in claim 10, wherein said projections are cylindrical in shape.

12. An automotive lighting assembly as claimed in claim 10, wherein said curable adhesive is selected from a group consisting of anaerobic adhesives, cyanoacrylate adhesives, acrylic adhesives, epoxy adhesives, polyurethane adhesives, silicone adhesives, phenolic adhesives, polymide adhesives, plastisol adhesives, and polyvinyl acetate adhesives.

* * * * *